US005135119A

United States Patent [19]

Larkin

[11] Patent Number: 5,135,119

[45] Date of Patent: Aug. 4, 1992

[54] RESCUE FRAME

[75] Inventor: Kenneth B. Larkin, Angourie, Australia

[73] Assignee: Spelean Pty. Limited, Sydney, Australia

[21] Appl. No.: 509,973

[22] Filed: Apr. 16, 1990

[30] Foreign Application Priority Data

Apr. 26, 1989 [AU] Australia ..... PJ3882

[51] Int. Cl.[5] ..... B66C 23/00

[52] U.S. Cl. ..... 212/255; 212/263; 212/265

[58] Field of Search ..... 212/189, 182, 211, 227, 212/231, 232, 236, 233, 239, 241, 244, 254, 255, 260–263, 265, 271

[56] References Cited

U.S. PATENT DOCUMENTS

| | | | |
|---|---|---|---|
| 73,748 | 1/1868 | Nichols | 212/263 |
| 1,958,824 | 5/1934 | Jones | 212/263 |
| 3,049,242 | 8/1962 | Stevens, Jr. et al. | 212/263 |
| 3,912,088 | 10/1975 | Bronfmen | 212/260 |
| 4,621,741 | 11/1986 | Boon | 212/265 |
| 4,782,962 | 11/1988 | Hackworth et al. | 212/255 |

FOREIGN PATENT DOCUMENTS

| | | | |
|---|---|---|---|
| 1188952 | 3/1959 | France | 212/263 |
| 506309 | 12/1954 | Italy | 212/255 |
| 304484 | 1/1955 | Switzerland | 212/254 |
| 703481 | 12/1979 | U.S.S.R. | 212/271 |
| 1230973 | 5/1986 | U.S.S.R. | 212/271 |

*Primary Examiner*—Sherman Basinger
*Attorney, Agent, or Firm*—Ladas & Parry

[57] ABSTRACT

A rescue frame to pivot about footings supported adjacent to an upper edge of a vertical incline. The rescue frame comprises a primary tubular member passing through the footings and having attached thereto a number of secondary tubular members so as to form a triangular pyramid having a pulley attached to it's apex such that upon pivoting the frame about the primary member, the pulley will extend out over the edge so that rope and stretcher may clear the incline during a lifting or lowering operation. Upon reaching the top of the incline, frame is pivoted back to laterally transfer the stretcher to another side of the primary member to safety located stretcher above the ground where it may be released from rope.

6 Claims, 2 Drawing Sheets

RESCUE FRAME

TECHNICAL FIELD

The present invention relates to rescue equipment and more particularly, though not exclusively, to a frame to support and raise a rescuee or other object through a generally vertical incline such as, for example, cliff faces, caves, sides of structures, edges of rivers and man holes.

For example, when an injured person at the bottom of a cliff needs to be transported by being raised up a cliff face to safety, it is usually necessary to have a rescue apparatus which projects outwards from the top of the cliff providing a lifting point spaced outwards from the plane of the cliff face. When a patient is being lifted up the side of the cliff face, such apparatus causes the patient to hang generally clear of the cliff-face.

BACKGROUND ART

Known apparatus can be awkward to use. That is, known apparatus comprises a vertically extending king pole which is placed generally proximate the cliff edge and a jib pivotably mounted at one end to a bottom portion of the king pole, the other end being supported from the top end of the king pole by means of a pre-set rope/pully system. The king pole is stabilized by means of guy ropes extending from the top end thereof to the ground where they are secured. The jib is caused to swing about a vertical axis between a position projecting outwards from the cliff edge, to a position where the end of the jib is located back from the cliff edge. The guy ropes limit the swinging movement of the jib thereby making it difficult to discharge the patient from the apparatus. Further, the known apparatus is awkward to set up and operate.

OBJECT OF THE INVENTION

It is the object of the present invention to overcome or substantially ameliorate the problems and/or disadvantages of the prior art.

DISCLOSURE OF THE INVENTION

There is disclosed herein a pivoting support structure comprising:

- a frame,
- at least one primary member of the frame being adapted to pivot about a longitudinal axis thereof,
- a plurality of secondary members of the frame, some of which extend substantially radially of the primary member(s),
- lifting means attached to one or more of the secondary members and spaced from the primary member(s) such that upon pivoting of the frame about the primary member(s), the lifting means rotates thereabout so as to laterally transfer from one side of the primary member to the other.

There is further disclosed herein a method of raising or lowering an object, the method comprising:

- providing a frame which pivots about a primary member thereof,
- attaching to the frame by means of rope or the like the object to be raised or lowered,
- raising or lowering the object while the frame is in a first pivotal orientation wherein the object is to one side of the primary member,
- pivoting the frame, so as to laterally transfer the object to the other side of the primary member, and
- detaching the object from the rope or the like.

BRIEF DESCRIPTION OF THE DRAWINGS

A preferred form of the present invention will now be described by way of example with reference to the accompanying drawings, wherein.

BEST MODE OF CARRYING OUT THE INVENTION

Figure 1:
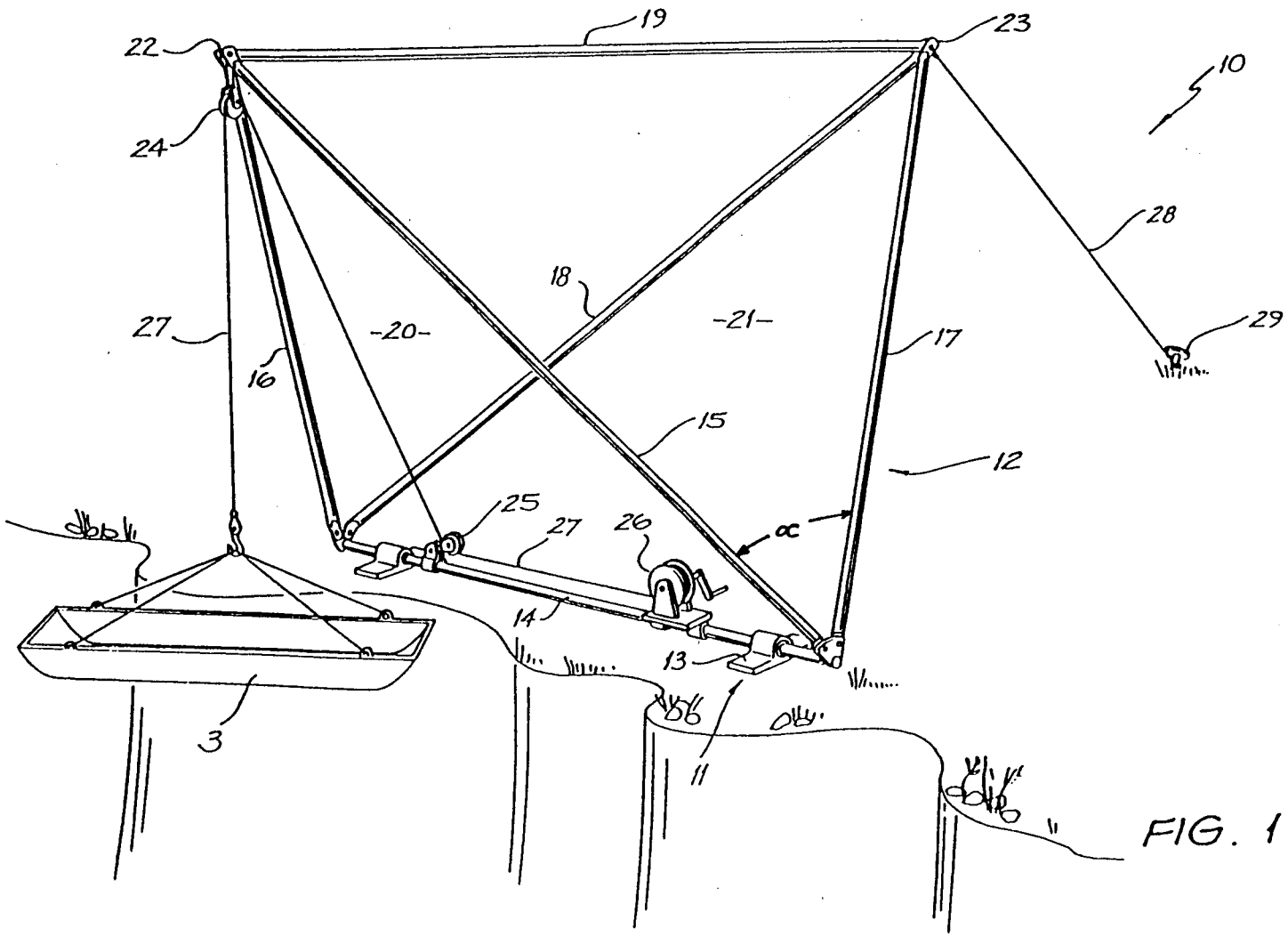
FIG. 1 is a schematic perspective view of the present apparatus in a first configuration.
Figure 2:
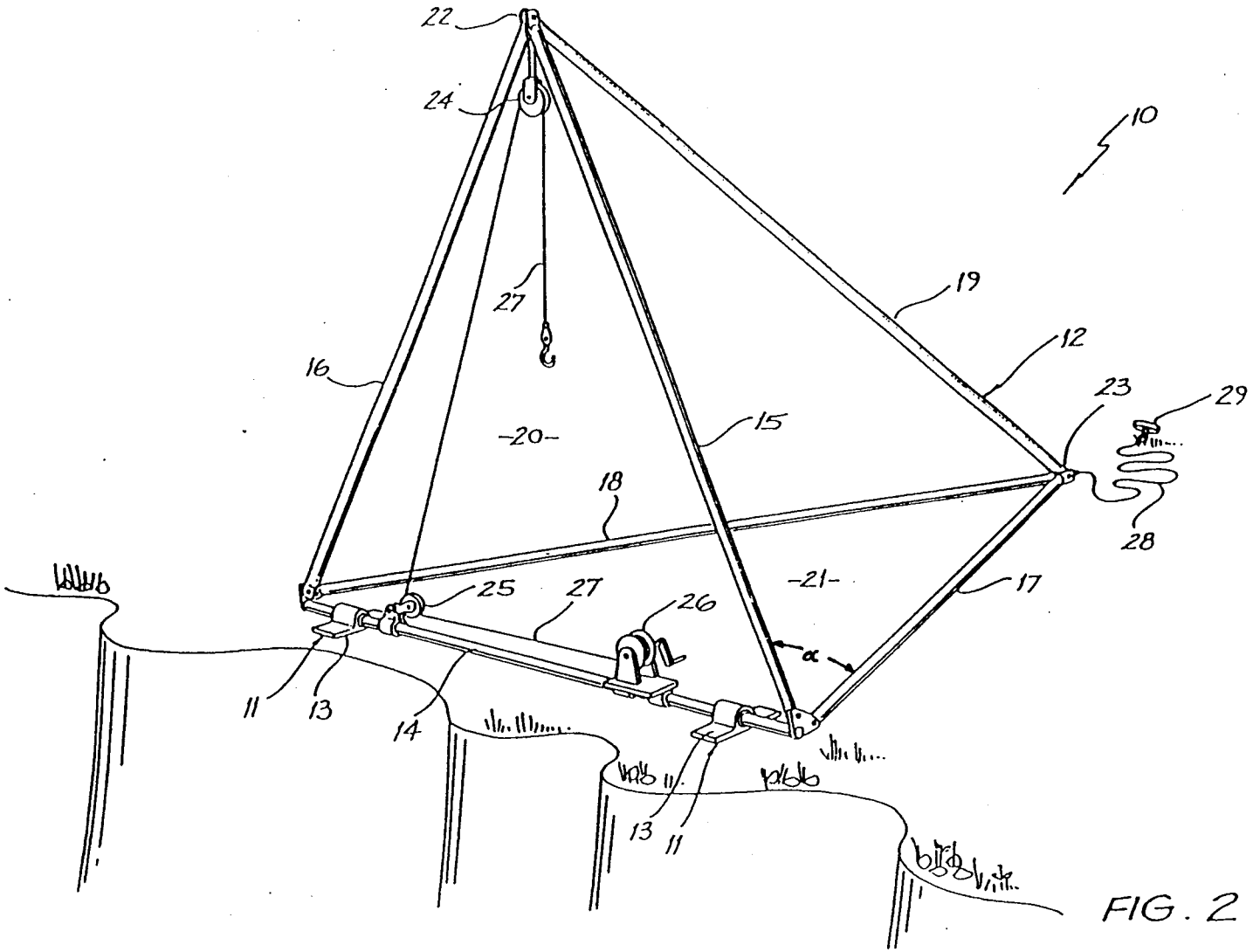
FIG. 2 is a schematic perspective view of the apparatus of FIG. 1 in a second configuration.

In the accompanying drawings there is schematically depicted a rescue apparatus 10 comprising ground engaging base members 11, and a generally rigid frame 12 pivotally mounted to the base members 11.

The base members 11 comprise footings 13 having hardened spikes (not shown) adapted to grip on the ground adjacent the cliff edge, with a cross-bar 14 of the frame 12 to be positioned generally parallel to the cliff edge and extending between the spaced base members 11. The cross-bar 14 is rotatably mounted to the base members 11 about the longitudinal axis thereof.

Alternatively the footings 13 comprise a flat planar portion to resist sinking into soft ground.

Detachably secured to the cross-bar 14 are four frame bars 15, 16, 17 and 18. Frame bars 15 and 16 are connected to each other at one end, and at their respective other ends detachably to opposite ends of the cross-bar 14. Similarly, frame bars 17 and 18 are connected to each other at one end, and at their respective other ends detachably connected to opposite ends of the cross-bar 14. A connecting bar 19 is attached at one end to the joint 22 of the frame bars 15 and 16, and at its other end to the joint 23 of the frame bar 17 and 18.

The frame 12 is configured so that frame bars 15 and 16 define a first A-frame 20, and frame bars 17 and 18 define a second A-frame 21. Each A-frame extends from the cross-bar 14 in respective planes which are at an angle $\alpha$of approximately 80° to 90°, and preferrably approximately 85°. This angle is dependent on the length of the connecting bar 19.

The apparatus can be fabricated in a variety of sizes and can also be made collapsible. That is each bar 15, 16, 17, 18, 19 may be provided with joiners (not shown) so as to allow the apparatus 10 to be assembled in either full size, half size or quarter size for example.

The apparatus 10 further comprises a pulley 24 attached at the joint 22, another pulley 25 attached at one end of the cross-bar 14, and a winch 26 mounted near the other end of the cross-bar 14. The winch 26 may be power driven or manually operated. A cable 27 is wound around the drum of the winch 26 and passes throught the pulleys 25 and 24 respectively. A guy wire 28 is attached at one end to the joint 23, and at its other end it is secured to a suitable anchor 29, for example, a tree, motor vehicle etc.

In use, the A-frame 21 of the apparatus 10 is disposed at an angle of approximately 45° from the horizontal so that the pulley 24 hangs from the joint 22 of the A-frame 20 at a position outwards from the plane of the cliff-face so that a patient, for example, on a stretcher can be winched up from the bottom of the cliff generally clear of the cliff face.

When the patient has been winched to the top of the cliff and hangs in the position shown in FIG. 1, the frame 12 can then be pivoted about the base members 11 so that the A-frame 21 is caused to rest on the ground wherein the pulley 24, and hence the patient depending therefrom, is behind the edge of the cliff. This allows easy removal of the patient in stretcher 3 from the apparatus 10 generally away from the cliff.

A light fitting (not shown) may be attached at joint 22 in addition to the normal load lifting fittings (ie. pulley 24) to permit illumination of an area for night or low light operations.

The load lifting means, that is, the winch may alternatively be located remote from the apparatus 10 on a suitable anchor.

The apparatus 10 may also be useful in other configurations. For example, the two A-frames 20 and 21 can be caused to stand upright (when one is detached from the cross-bar 14) which are spaced apart due to the connecting bar 19 so as to define a frame for a shelter. Alternatively, the apparatus 10 may be configured as a tripod using three of bars 15, 16, 17, 18 or half of each, Any bar 15, 16, 17, 18 or 19 may be used as a king post;

Bars 15, 16, 17, 18 and 19 may be joined, and, with suitable guys and anchors, be used as a radio mast, lighting support mast or scaling pole.

The detachability of the bars 14, 15, 16, 17, 18 and 19 allows for easy storage and transport of the apparatus 10.

What I claim is:

1. A rescue apparatus comprising:

a triangular pyramidal-like frame formed by frame bar members that are detachably interconnected, at one end of each said frame bar member to a cross-bar, and at an other end of each said frame bar member said frame bar members are detachably interconnected to a connecting-bar so as to form two A-frames having upper apexes that are connected to said connecting bar;

ground engagement means rotatably connected to said cross-bar and connected to a ground surface so that said frame is manually rotatable about a longitudinal axis of said cross-bar; and lifting means attached to said frame such that upon rotation of said frame about the longitudinal axis of said cross-bar, said lifting means is moved laterally, said lifting means comprising a pulley attached to one of said apexes of one of said A-frames and a winch located on said cross bar.

2. The apparatus of claim 1, wherein the ground engaging means includes flat planar footings.

3. The apparatus of claim 1, wherein the A frames are angled from one another from 80° to 90°.

4. The apparatus of claim 3, wherein the lifting means further comprises a cable.

5. The apparatus of claim 4, further comprising an anchor attached to the frame to limit the rotation of the frame.

6. The apparatus of claim 1, wherein the lifting means further comprises a pulley attached to said cross bar near one end of the cross bar, and wherein said winch is mounted near an other end of said cross bar.

* * * * *